United States Patent [19]

Dunn et al.

[11] 4,002,391

[45] Jan. 11, 1977

[54] INSULATION SLICING TERMINAL

[75] Inventors: Robert Brian Dunn, Ottawa; John Davidson Lee, Manotick, both of Canada

[73] Assignee: Northern Electric Company, Limited, Montreal, Canada

[22] Filed: Mar. 3, 1976

[21] Appl. No.: 663,260

[52] U.S. Cl. ..... 339/98

[51] Int. Cl.[2] ..... H01R 13/38

[58] Field of Search ..... 339/97–99

[56] References Cited

UNITED STATES PATENTS

| | | | |
|---|---|---|---|
| 3,234,498 | 2/1966 | Logan | 339/97 P |
| 3,798,587 | 3/1974 | Ellis, Jr. et al. | 339/97 P |

*Primary Examiner*—Joseph H. McGlynn
*Attorney, Agent, or Firm*—Sidney T. Jelly

[57] ABSTRACT

An insulation slicing terminal, stamped from electrically conducting sheet material, has a base portion and two cantilevered legs extending from the base portion providing opposed side edges between which a conductor is positioned. The top edge and side edge of each leg intersect at an abrupt angle to form insulation slicing edges, the two top edges forming a shallow Vee formation. An initial small gap is provided between the side edges by a first swage on one leg near the junction with the base portion. A further swage on one of the legs nearer the top of the leg acts to prevent movement of the conductor out of the terminal once the wire is inserted past the further swage. As a further feature, the shallow Vee formation, of the top edges, has an apex prior to slitting which is a radiused flat, permitting off-center tolerances on slitting without detrimentally affecting the insulation slicing edges.

7 Claims, 8 Drawing Figures

INSULATION SLICING TERMINAL

This invention relates to insulation slicing terminals and is particularly concerned with maintaining a stable connection between an electrical conductor and a terminal.

Insulation slicing terminals of various types exist, a particular example being that described in U.S. Pat. No. 3,421,221 dated July 21, 1970, in the name of the present assignees. In insulation slicing terminals an insulated conductor is pushed down between two cantilevered legs, the insulation being sliced as the conductor is pushed down, a small portion of insulation removed on each side of the conductor to permit electrical contact between the legs and the conductor.

The use of such terminals is extending and smaller versions are now being proposed for use in telephone sets and other items. Such terminals provide quick connection, avoiding soldered connections or screw connections. However, it has been found that such terminals are subject to loss of connection due to a conductor moving out of the terminal, for example as a result of vibration.

The present invention provides a positive stop to prevent movement of a conductor out of a terminal. The invention also provides, as a subordinate feature, a particular formation of the terminal punch, which permits more satisfactory slitting of the blank, providing for normal manufacturing tolerances while still producing satisfactory insulatior cutting edges.

A terminal is of electrically conducting sheet material and comprises a base portion and a pair of adjacent legs cantilevered from the base portion, the legs having opposed side edges for reception of a conductor therebetween; each leg having a top edge, the top edges inclined towards each other in a shallow Vee formation and intersecting the related side edge at an abrupt angle to form insulation slicing edges, therebeing a first swage on the side edge of one leg, positioned near the junction of the leg and base portion to maintain a small gap between the opposed side edges and a further swage on the side edge of one of the legs, positioned between the first swage and the Vee formation, so that on insertion of an insulated conductor, the insulation is sliced from opposite sides of the conductor by the insulation slicing edges as the conductor is forced into the small gap between the side edges and past the further swage, the further swage preventing movement of the conductor out of the terminal.

Conveniently, the apex of the Vee formation, before slitting, is in the form of a radiused flat lying within a circular segment defined by a minimum radius and cord of about 0.003 inches and a maximum radius and cord of about 0.010 inches.

The invention will be readily understood by the following description of certain embodiments, by way of example, in conjunction with the accompanying drawings, in which.

Figure 1:
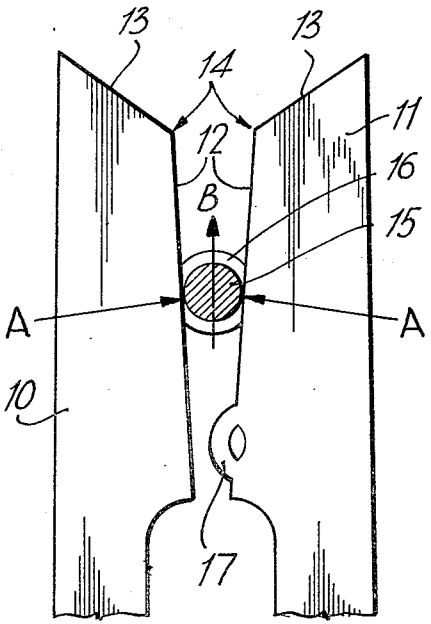
FIG. 1 is a view of a terminal, illustrating direction of forces acting on a conductor.

As illustrated in FIG. 1, a terminal has opposed legs 10 and 11, the legs extending from a base portion, not shown, the legs 10 and 11 being cantilevered from the base portion and having opposed faces or edges 12. The top edges 13 of the legs are inclined in a shallow Vee formation, the top edges 13 intersecting the opposed edges 12 at an abrupt angle and thereby form an insulation slicing formation 14 at each intersection. The legs 10 and 11 are forced apart slightly as the insulated conductor 15 is forced down between them. As the insulated conductor is forced past the slicing formation 14 a small portion of the insulation 16 around the conductor 15 is removed on each side. A small initial clearance is provided between the legs 10 and 11 by a swage 17 on one leg near the bottom of the edge 12. As the conductor is pushed down between the legs 10 and 11 the legs are forced further apart, as in FIG. 1. The conductor is in electrical contact with the edges 12.

Once in position, the conductor 15 is gripped between the legs 10 and 11, the gripping force a product of the outward straining of the legs. In conventional terminals, in which relatively long legs 10 and 11 are provided, compared with the opening of the legs by the conductor, difficulties of wire movement do not normally occur. However, in small terminals, in which the length of the legs 10 and 11 is short, the vibrations on the conductor car cause slipping. Thus, in FIG. 1, the reaction on the conductor 15 by the legs 10 and 11, indicated by arrows A will create a resultant force in the direction of arrow B. The shorter the legs 10 and 11 relative to the opening or gap between the legs, the larger the force represented by arrow B. As a result, vibration can cause the conductor 15 to slip, in the direction of the arrow B, and eventually move out of the terminal.

Figure 3:
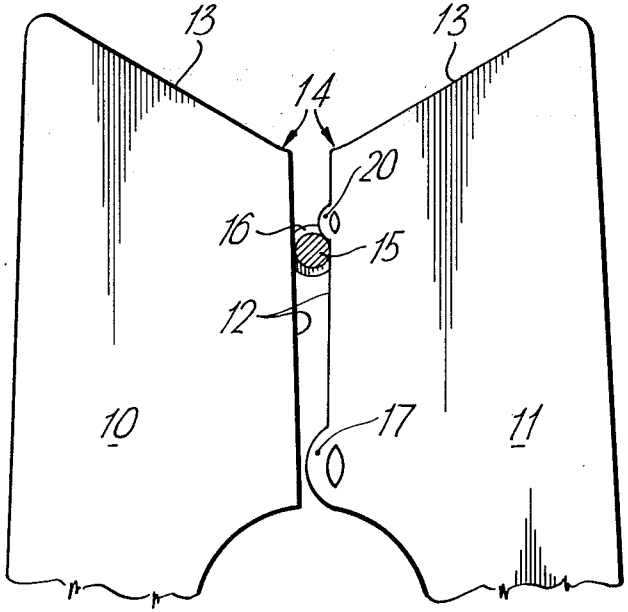
FIG. 3 is an enlarged view of the portion within the circle X of FIG. 2.
Figure 2:
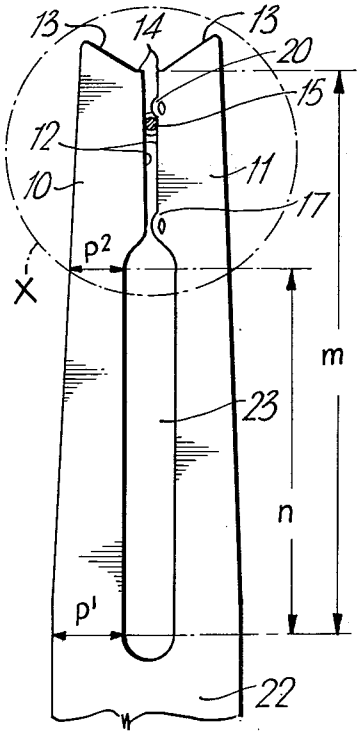
FIG. 2 is a view of a terminal modified in accordance with the present invention.

With smaller terminals, the gripping force applied by the legs is reduced. At the same time the angle subtended by the edges 12 increases. This results in the squeezing out of the conductor. FIGS. 2 and 3 illustrate a modification which completely prevents slipping, or squeezing, out of a conductor. A small swage 20 is formed on one of edges 12 of one leg — in the example on leg 11, the same leg as has already been swaged at 17. However, the swage 20 can be formed on the other leg 10 if more convenient. The conductor 15 is pushed down past the swage 20, and may finally be positioned at some position which is well below the swage 20. In the event of the conductor moving upwards, as by vibration, it will eventually come into contact with the swage 20 and be prevented from making any further movement out of the terminal.

A terminal should accept a range of conductor sizes. The various features which are of relevance are:

i. the length of the legs 10 and 11 from the cutting formations 14 to the base portion 22 (*m* in FIG. 2);

ii. the length of the flexing portion of the legs (*n* in FIG. 2);

iii. the yield and tensile strength of the material from which the terminal is formed;

iv. the initial opening provided;

v. the additional opening resulting from passage of the conductor past the swage 20.

Also, the positioning of the swage 20 relative to the cutting formations 14 is important.

Thus, the swage 20 should be as high up the leg as possible, to provide a longer "beam" and thus reduce stresses in the material, both in the legs and at the junction of the legs with the base portion 22. But, the swage must not be so high up as to interfere with the entry of the conductor and slicing of the insulation. The diameter of the conductor 15 will also affect the stress on the material, and also the distance down the legs the conductor is pushed.

The terminal, as hereinafter described, is particularly intended to accept conductors in the range 26 to 22 AWG. To do this the following dimensions have been found acceptable. The swage 20 extends from the plane of the edge 12 a distance of 0.003 inches with a tolerance of ±0.001 inches. The centre line of the swage is about 0.002 inches from the intersection of the edges 12 and 13 and the swage extends about 0.008 inches either side of the centre line in the direction parallel to the edge 12. The swage is formed by swaging from both sides of the same leg. The profile of the swage is rounded and blended into the edge 12. The outermost limit of the swage is about 0.015 inches from the intersection of the edges 12 and 13. This limit is set, as a minimum, such that the insulation will have been cut before the conductor engages with the swage 20.

The initial opening, or gap, between the legs 10 and 11, at the intersection of the edges 12 and 13 is 0.008 inches ±0.001 inches. This is provided by the swage 17. This initial opening is smaller than the smallest conductor to be gripped, for obvious reasons, but is such that there is an initial entry for the conductor to avoid damage thereto. The included angle between the edges 13 is approximately 120° substantially symmetrical about a central axis of the terminal and the distance from the extreme tip of each leg to the junction with the base portion — *m* in FIG. 2, is 0.394 inches ±0.002 inches. Other dimensions are length of enlarged slot 23 - *n* in FIG. 2, is 0.238 inches ±0.002 inches and the width of the legs at the slot 23 - $p^1$ at the lower end of the slot and $p^2$ at the upper end in FIG. 2 - is 0.0465 inches ±0.001 inches and 0.035 inches ±0.002 inches respectively. A typical material, for such dimensions is phosphor bronze 0.028 inches thick strip, extra spring temper, for example alloy 510 per ASTM B-103. It will be appreciated that the critical dimensions derive from a compromise between ease of flexing of the legs to enable the conductor to pass the swage 20 without significant damage and sufficient pressure to maintain good contact between the terminal and conductor, while not overstressing the material. For example, it has been found that, with the above material and dimensions, a deflection of a leg up to about 0.017 inches can be obtained without overstressing, and with sufficient strength to give good contact. It is possible to vary the dimensions, and material, provided the overall requirements are met. For different ranges of conductor sizes, different dimensions and/or materials will apply.

The included angle between the edges 13 can also vary. The angle of 120° has been found to be an optimum for clean cutting of the insulation and providing for a large number of re-connections. However both sharper and shallower Vee formations can be used, for example up to ±10°, ±15° or even ±20°, but with a decrease in efficient performance. Thus, with a sharper Vee formation, a smaller number of reconnections are available before the insulation slicing edges are too blunt. Tapering of the legs 10 and 11 helps to spread the stresses as does the radius at the lower or inner end of the slot 23.

Figure 4:
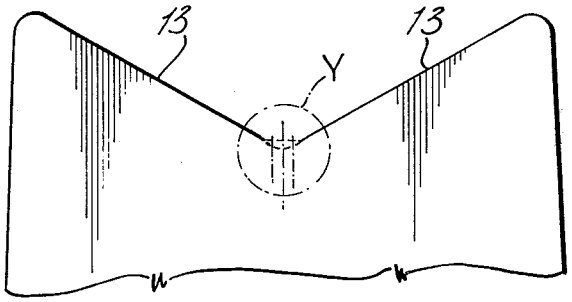
FIG. 4 is an enlarged view of the portion illustrated in FIG. 3, before slitting.

A terminal is produced by stamping or pressing, from a strip, the external profile and slots 23 being formed. The terminal is then slit to form the edges 12, and then swaged - to form swages 17 and 20. It is desirable to form a good insulation cutting edge at the intersection of the edges 12 and 13. If the angled end faces 13 are formed so as to connect in a sharp corner, and if the slitting is not exactly on the centre line of the angle, a slight hook shape can be formed on one of the corners at the intersection of edges 12 and 13. To avoid this it is provided that the corner at the intersection of edges 13, prior to slitting, is modified. This is seen in FIGS. 4 and 5 which are enlarged views of the ends of a terminal before slitting and of the intersection of the edges 13 respectively.

Figure 5:
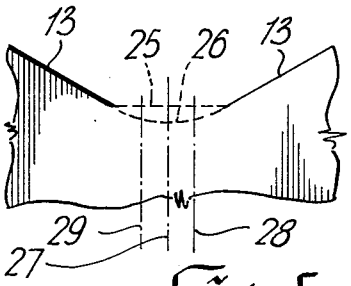
FIG. 5 is a view of the portion in the circle Y of FIG. 4, further enlarged.

Particularly as illustrated in FIG. 5, the two surfaces 13 converge at a blended radiused flat. The form of the radiused flat lies within a circular segment formed by a .007 inches long cord. That is, within the segment defined by dotted straight line or cord 25 and the dotted arc 26 in FIG. 5. As seen in FIG. 5, while the ideal slitting line is indicated at 27, slitting can occur at either 28 or 29 without unduly affecting the cutting edge or formation.

After forming of the terminal, including swaging, it is plated to improve electrical contact characteristics.

Figure 7:
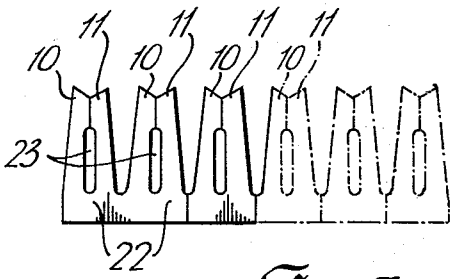
FIGS. 7 and 8 are views of other forms of multiple terminal arrangements in accordance with the present invention.
Figure 8:
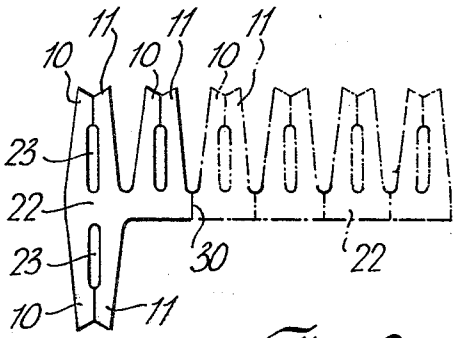
Figure 6:
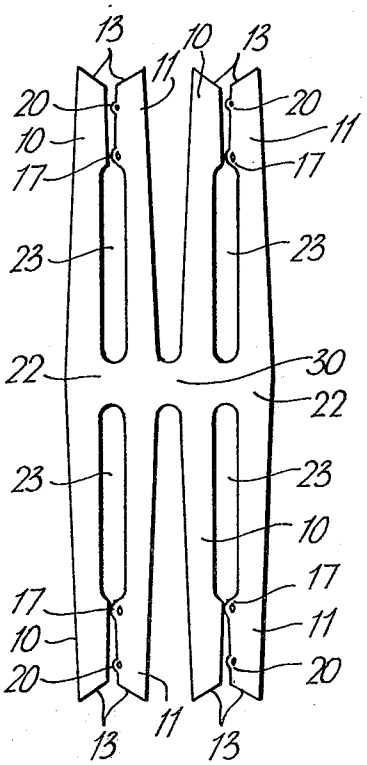
FIG. 6 is a view of one form of multiple terminal arrangement in accordance with the present invention.

Terminals can be formed in a number of arrangements. Conveniently they are formed as opposed pairs, as one or more opposed pairs to form a unit, or as a plurality of single ended terminals side by side; a combination of opposed pairs and single ended terminals and in other arrangements. Terminals can be formed in continuous strips and broken or cut off at desired numbers of terminals. FIG. 6 illustrates an arrangement of two opposed pairs side by side, the terminals paired by a narrow web 30. The web 30 is such as to not interfere significantly with the flexing of the adjacent legs of the terminals. FIG. 7 illustrates a strip of single ended terminals, the number being variable. FIG. 8 illustrates the combination of opposed pairs and single ended terminals.

An insulated conductor is applied to the terminal by a tool which has a slot which receives a pair of legs 10 and 11. The insulated conductor 15 is positioned on the top of a terminal, resting in the Vee formed by the edges 13, being centered by the Vee formation. The tool is positioned over the terminal and pushed down. This forces the insulated conductor 15 down into the gap between the legs 10 and 11. The cutting formations, at the intersections of edges 12 and 13, slice the insulation and as the insulated conductor is pushed down a small piece of insulation is removed from each side, revealing the conductor. The pushing of the conductor down between the legs 10 and 11 forces the legs further apart. Slicing of the insulation is aided by the initial small gap formed by the swage 17. The conductor 15 is forced past the swage 20, opening the legs 10 and 11 further, and then after the conductor has moved past the swage 20, the legs close together to some extent, tightly gripping the conductor. The conductor may be finally positioned at some position below the swage 20, but in the event of it moving upward it is prevented from being ejected from the terminal by the swage 20. Conductors can be removed from the terminal, and the terminal reused.

What is claimed is:

1. An insulation slicing terminal for insulated electrical conductors, said terminal of electrically conducting sheet material, comprising:

a base portion;

a pair of adjacent legs cantilevered from said base portion, said pair of legs including opposed side edges for reception of a conductor therebetween;

each of said legs further including a top edge, said top edges inclined towards each other in a shallow Vee formation, the top edge of each leg intersecting the related side edge at an abrupt angle to form insulation slicing edges;

a first swage on the side edge of one of said legs, said first swage positioned near the junction of said leg with said base portion and extending from the plane of the side edge to maintain a small gap between said opposed side edges;

a further swage on the side edge of one of said legs, said further swage at a position between said first swage and said shallow Vee formation;

the arrangement such that on positioning an insulated connector in said Vee formation, the insulation is sliced from opposed sides of the conductor by said insulation slicing edges as the conductor is forced into said small gap between the opposed side edges and past said further swage, said further swage adapted to prevent movement of said conductor out of said terminal.

2. A terminal as claimed in claim 1, said shallow Vee formation having an included angle of between about 100° and 140°, substantially symmetrical about a central axis of the terminal.

3. A terminal as claimed in claim 2, said shallow Vee formation having an included angle of 120° ± 10°.

4. A terminal as claimed in claim 1, the outer extremity of said further swage positioned a distance from said intersection of said top and side edge equal to at least the diameter of the largest conductor to be connected to said terminal.

5. A terminal as claimed in claim 1, including a plurality of pairs of adjacent legs.

6. A terminal as claimed in claim 1, said Vee formation having an apex, prior to slitting, in the form of a radiused flat within a circular segment, said circular segment having a minimum radius and cord of about 0.003 inches and a maximum radius and cord of about 0.010 inches.

7. A terminal as claimed in claim 6, said circular segment having a radius and a cord of about 0.007 inches.

* * * * *